US005935479A

United States Patent [19]

Lee

[11] Patent Number: 5,935,479

[45] Date of Patent: Aug. 10, 1999

[54] MICROWAVE OVEN WITH TWO MICROWAVE OUTPUT APERTURES

[75] Inventor: Eung-Sup Lee, Suwon, Rep. of Korea

[73] Assignee: Samsung Electronics Co., Ltd., Rep. of Korea

[21] Appl. No.: 08/984,079

[22] Filed: Dec. 9, 1997

[30] Foreign Application Priority Data

Oct. 15, 1997 [KR] Rep. of Korea ..... 97-52913

[51] Int. Cl.[6] ..... H05B 6/72

[52] U.S. Cl. ..... 219/746; 219/748; 219/750

[58] Field of Search ..... 219/746, 745, 219/748, 747, 750, 695, 696

[56] References Cited

U.S. PATENT DOCUMENTS 5,057,660 10/1991 Yamada et al. ..... 219/746
5,352,873 10/1994 Carlsson et al. ..... 219/746
5,468,940 11/1995 Kang ..... 219/746
5,567,339 10/1996 Joo et al. ..... 219/748
5,742,033 4/1998 Park ..... 219/746

*Primary Examiner*—Philip H. Leung
*Attorney, Agent, or Firm*—Larson & Taylor

[57] ABSTRACT

A waveguide of a microwave oven is provided to keep constant output and electric field distribution at a cavity regardless of food load by minimizing change in impedance of waveguides depending on food load for cooking, the waveguide comprising radiating holes of first and second output waveguides formed at top and bottom parts of a lateral wall of the cavity centering the power supply hole of the input waveguide to spray microwaves having the electric fields of opposite phases, whereby change in impedance of the waveguide depending on the change in food load is minimized to keep the output from the microwave oven and the electric field distribution constant regardless of food load.

4 Claims, 10 Drawing Sheets

MICROWAVE OVEN WITH TWO MICROWAVE OUTPUT APERTURES

BACKGROUND OF THE INVENTION

1. Field of the Invention

The present invention relates to a microwave oven which heats food with microwaves for cooking and more particularly to a microwave oven waveguide where electric output and electric field distribution at a cavity are kept constant regardless of food load by minimizing change in impedance of the waveguide depending on food load for cooking.

2. Description of the Prior Art

Generally, a microwave oven is designed to radiate microwaves generated from a magnetron through a waveguide for heating food placed at a cavity to be dielectric heated for cooking.

FIG. 1 is a brief sectional view of a waveguide of a microwave oven in accordance with a first embodiment of the conventional art, and FIG. 2 is a structure analysis drawing of a waveguide shown in FIG. 1. One side of the waveguide(1) includes a magnetron insertion hole(9) while the other side thereof includes a rectangular shape of opening(7) for radiating the microwaves generated from the magnetron(3) into the cavity.

The microwaves generated from the magnetron(3) are radiated inwards through the waveguide(1) for heating food at the cavity(5) to be dieletric heated.

Here, as shown in FIG. 2', if power from the magnetron(3) is $P_{in}$, and if electric output to a specific position of the cavity(5) is $P_{out}$, then, $P_{out}$ is expressed in the following mathematical formula.

$$P_{in}=E^2_s \quad \text{Formula 1}$$

$$E_y=E_s \sin(x) \quad \text{Formula 2}$$

$$P_{out}=(E_y)^2=(E_s \sin(x))^2=E^2_s \sin(x)^2 \quad \text{Formula 3}$$

At the first through third mathematical formulas, $E_s$ is electric field energy formed by the microwave generated from the magnetron(3), namely input electric field energy, $E_y$ is electric field energy formed at the specific position of the cavity(5), namely the output electric field energy.

The output of the magnetron(3) is obtained by squaring the electric field power, $E_s$, formed by the microwaves generated therefrom. As the microwaves generated from the magnetron(3) is a specific phase, namely a sine wave, the electric field energy at the specific position of the cavity, $E_y$, is obtained by multiplying the sine value, sin (x), to the electric field energy formed by the microwaves, $E_s$, and the output at a the specific position of the cavity, $P_{out}$, is obtained by squaring the electric field energy, $E_y$.

Therefore, the output at the specific position of the cavity, $P_{out}$ is formed as results from multiplying the sine value, sin (x), to the output from the magnetron, $P_{in}$, wherein the sine value, sin (x) or the phase, is changed according to load of food to be cooked, thereby changing the output at the specific position of the cavity(5), $P_{out}$.

The characteristic impedance of the waveguide according to the load change of food is described in a polar chart, as shown in FIG. 3. FIG. 3 illustrates the characteristic impedance according to the water load of 2000, 1000, 500 and 100 cc at a microwave frequency range of 2.44–2.47 GHz.

As shown in FIG. 3, in case that the water load is 2000 cc, the impedance of waveguide, voltage standing wave ratio (VSWR), is low. On the other hand, in case that the water load is 100 cc, the impedance of waveguide, voltage standing wave ratio(VSWR) is so high that output from the microwave oven is of small quantity.

Though the output from the microwave oven is somewhat high in case of large food load, there is a problem in that the impedance of the waveguide is increased leading to low output from the microwave oven in case of small food load.

In addition, there is another problem in that the electric field distribution at the cavity is not kept constant because the change in the impedance of the waveguide becomes big according to the change in food load to be cooked.

Furthermore, even if the impedance of the waveguide is to be matched to that of the cavity to improve the output from the microwave oven, the aforementioned structure of the waveguide is not designed to get the impedance thereof and that of a specific cavity matched. Therefore, there is further problem in that one waveguide can not be adapted to a variety of cavities, so that each waveguide is to be designed for respective cavity.

On the other hand, a waveguide of a microwave oven disclosed at a Japanese laid-open patent No. Hei 6-111933 is developed to improve the equalized heating efficiency at food of a cavity thereof, and to shorten the waveguide for making an easy arrangement of electric parts therein.

As shown in FIG. 4, the waveguide is provided with one pair of wave supply holes(11*a* and 11*b*) at one side wall, a cavity(12) to get food to be cooked placed in, a magnetron (14) disposed between the wave supply holes(11*a* and 11*b*) apart from the lateral wall having the wave supply holes(11*a* and 11*b*) to generate the microwave of $\lambda_g$ frequency, a waveguide being at $\lambda_g/4$ distant from an antenna(13), having a separating plane in parallel to the antenna(13), covering the wave supply holes(11*a* and 11*b*), supporting the magnetron(14) and guiding the microwave passed through the wave supply holes(11*a* and 11*b*) to the cavity(12).

In case of the waveguide of the microwave oven described above, the wave generated from the magnetron (14) forms at the waveguide the voltage standing wave which is radiated into the cavity through the wave supply holes(11*a* and 11*b*) for equally heating the food therein.

However, in the conventional waveguide of the microwave oven a pair of wave supply holes(11*a* and 11*b*) are formed at upper portion of one lateral wall of the cavity(12), and microwaves generated from the magnetron(14) are radiated through the wave supply holes(11*a* and 11*b*). Therefore, even if the waveguide made a contribution to improving in equalized heating efficiency of food owing to a better radiating function of the microwaves, there is a problem in that the waveguide is not properly adapted to the change of the output from the microwave oven according to the food load.

SUMMARY OF THE INVENTION

The present invention is presented to solve the aforementioned problems and it is an object of the present invention to provide a waveguide which minimizes change in impedance thereof depending on the change of food load to keep output from a microwave oven constant regardless of food load for cooking.

There is another object of the present invention to provide a waveguide in the microwave oven which minimizes change in the impedance thereof to keep the electric field distribution at a cavity constant depending on food load.

In order to achieve the object of the present invention, there is provided a waveguide of a microwave oven having an input waveguide connected to a magnetron for supplying microwaves generated from the magnetron through a power supply hole, and a first and a second output waveguides connected to the power supply hole of the input waveguide for separating the microwaves transmitted from the input waveguide at different phases and for radiating the microwaves into a cavity for getting the food dielectric heated, wherein the waveguide comprises radiating holes of the first and second output waveguides formed at top and bottom parts of a lateral wall of a cavity centering the power supply hole of the input waveguide to spray the microwaves having the electric fields of opposite phases, whereby change in impedance of the waveguide depending on the change in food load is minimized to keep the output from the microwave oven and the electric field distribution constant regardless of food load.

BRIEF DESCRIPTION OF THE DRAWINGS

For fuller understanding of the nature and objects of the invention, reference should be made to the following detailed description taken in conjunction with the accompanying drawings in which:

FIG. 2' is a power distribution diagram of the waveguide depicted in FIG. 2;

DETAILED DESCRIPTION OF THE INVENTION

Figure 2:
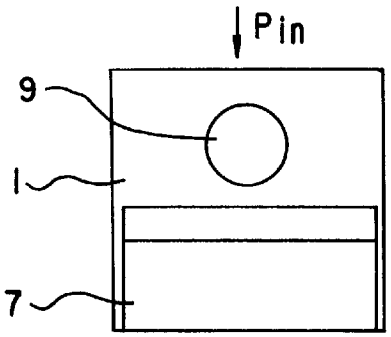
FIG.2 PRIOR ART
FIG. 2 is a structure analysis drawing of the waveguide shown in FIG. 1.
Figure 2:
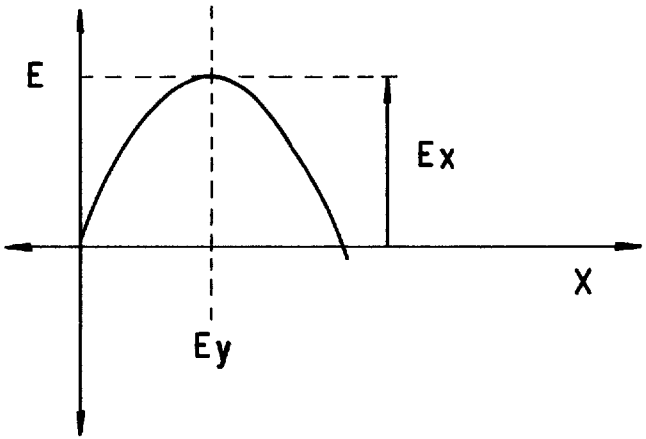
FIG.2' PRIOR ART
Figure 1:
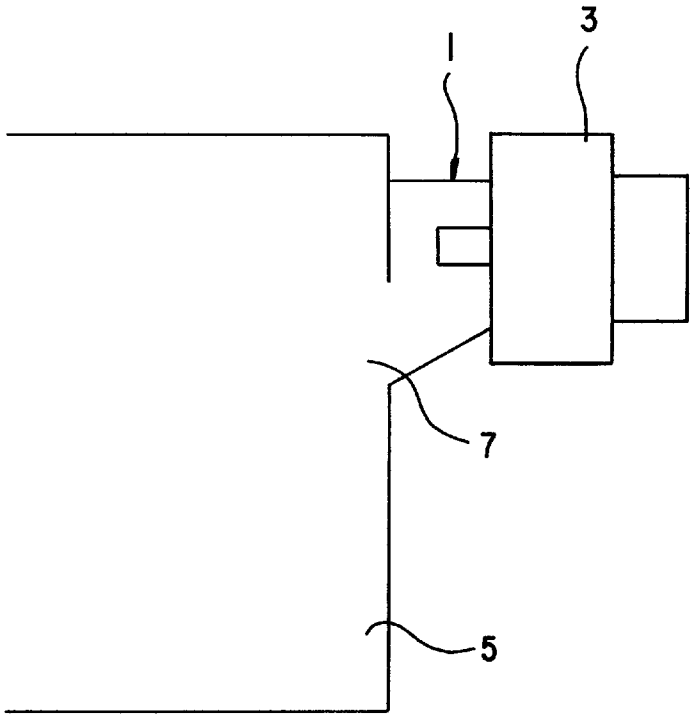
FIG.1 PRIOR ART
FIG. 1 is a brief sectional view for illustrating a conventional waveguide of a microwave oven in accordance with a first embodiment.
Figure 3:
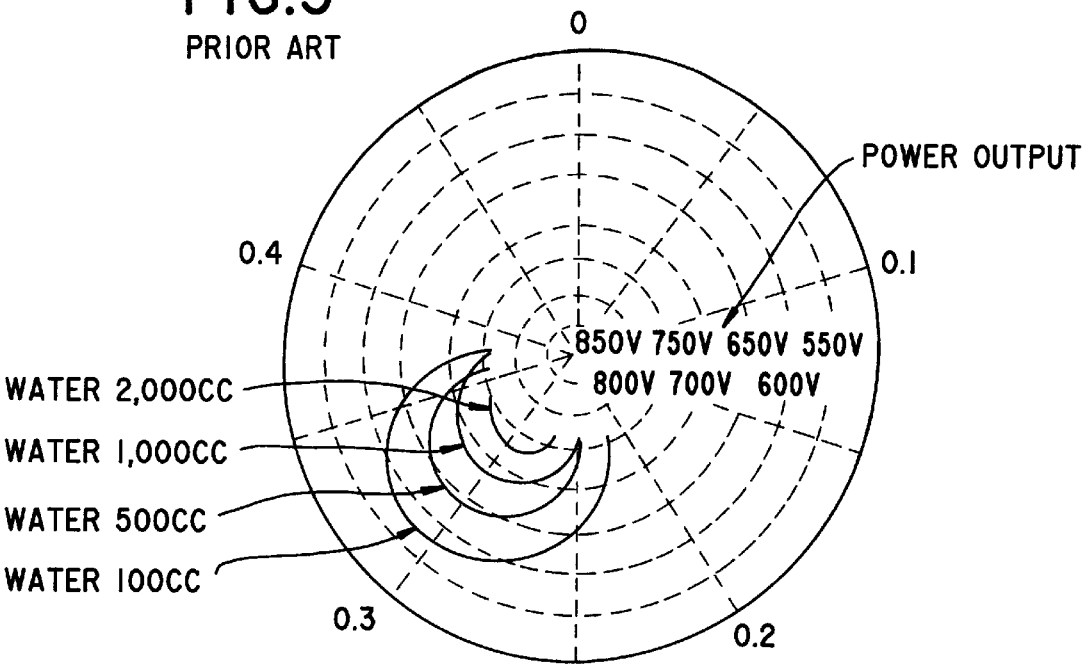
FIG.3 PRIOR ART
FIG. 3 is a polar chart for illustrating characteristic impedance of the waveguide according to food load shown in FIG. 1.
Figure 4:
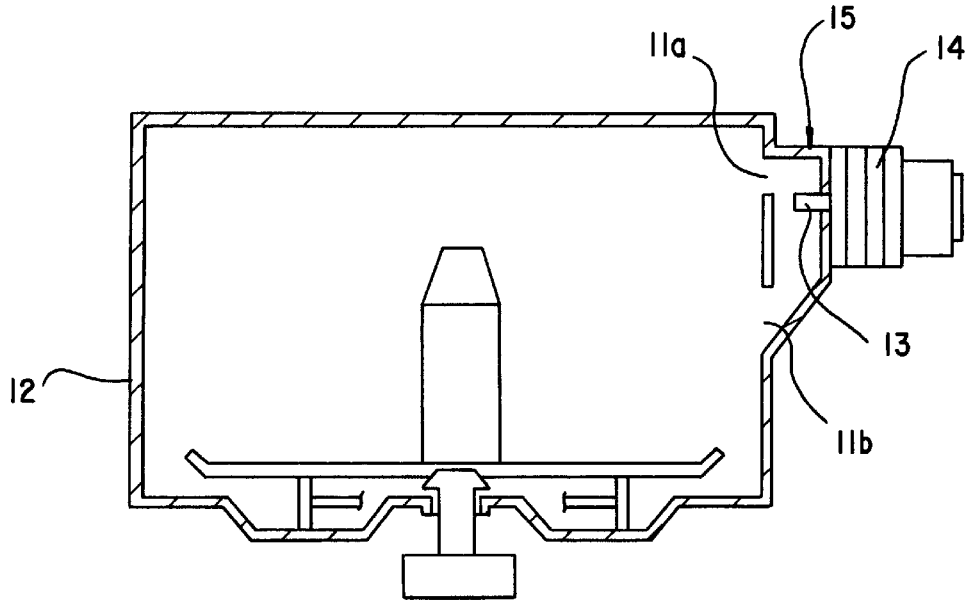
FIG.4 PRIOR ART
FIG. 4 is a brief sectional view of a conventional microwave oven in accordance with a second embodiment.
Figure 5:
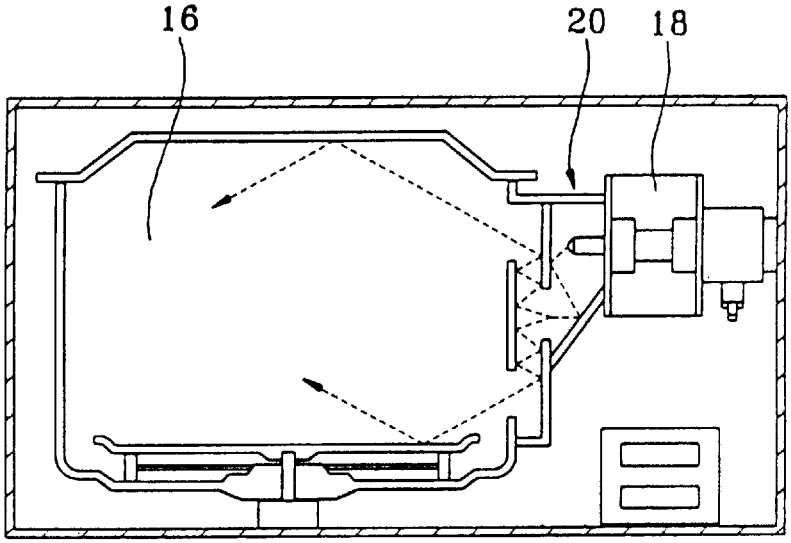
FIG. 5 is a brief sectional view of a microwave oven in accordance with the present invention.
Figure 6:
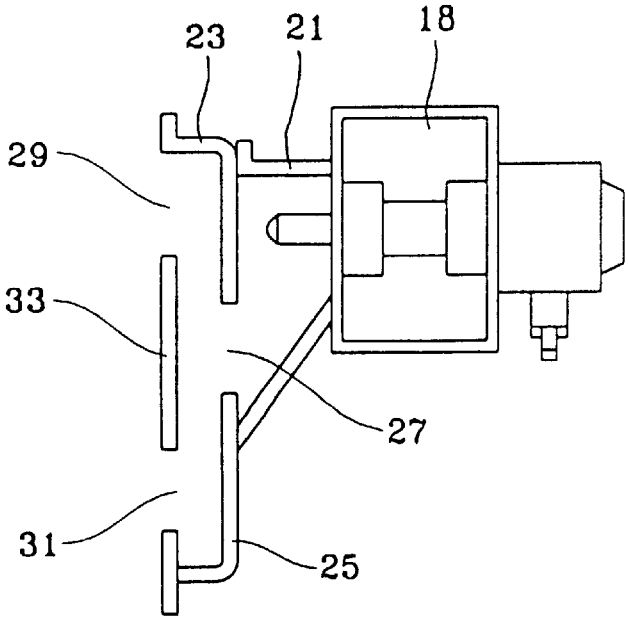
FIG. 6 is an enlarged view of a waveguide shown in FIG. 5.

A preferred embodiment of the present invention is described in detail with reference to the accompanying drawings. FIG. 5 is a brief sectional view of a microwave oven in accordance with the present invention while FIG. 6 is an enlarged view of a waveguide shown in FIG. 5. The microwave oven shown in FIGS. 5 and 6 includes a waveguide which spray microwaves into a cavity through a lateral wall thereof.

As shown in FIG. 5, the microwave oven of the present invention comprises a cavity(16) for placing food to be cooked, a magnetron(18) for generating microwaves at a frequency of $\lambda_g$ and a waveguide(20) for guiding microwaves generated from the magnetron(18) to the cavity(16).

As shown in FIG. 6, the waveguide(20) is provided with an input waveguide(21), a first output waveguide(23) and a second output waveguide(25), wherein the input waveguide (21) is connected to the magnetron(18) for supplying microwaves generated from the magnetron(18) to the first and second output waveguides(23 and 25).

The first output waveguide(23) is provided for radiating microwaves supplied through the power supply hole(27) of the input waveguide(21) through a radiating hole(29) into the cavity, while the second output waveguide(25) is provided for radiating through a radiating hole(31) microwaves of electric field at an opposite phase to that of the microwaves radiated into the cavity through the first output waveguide(23).

Figure 7:
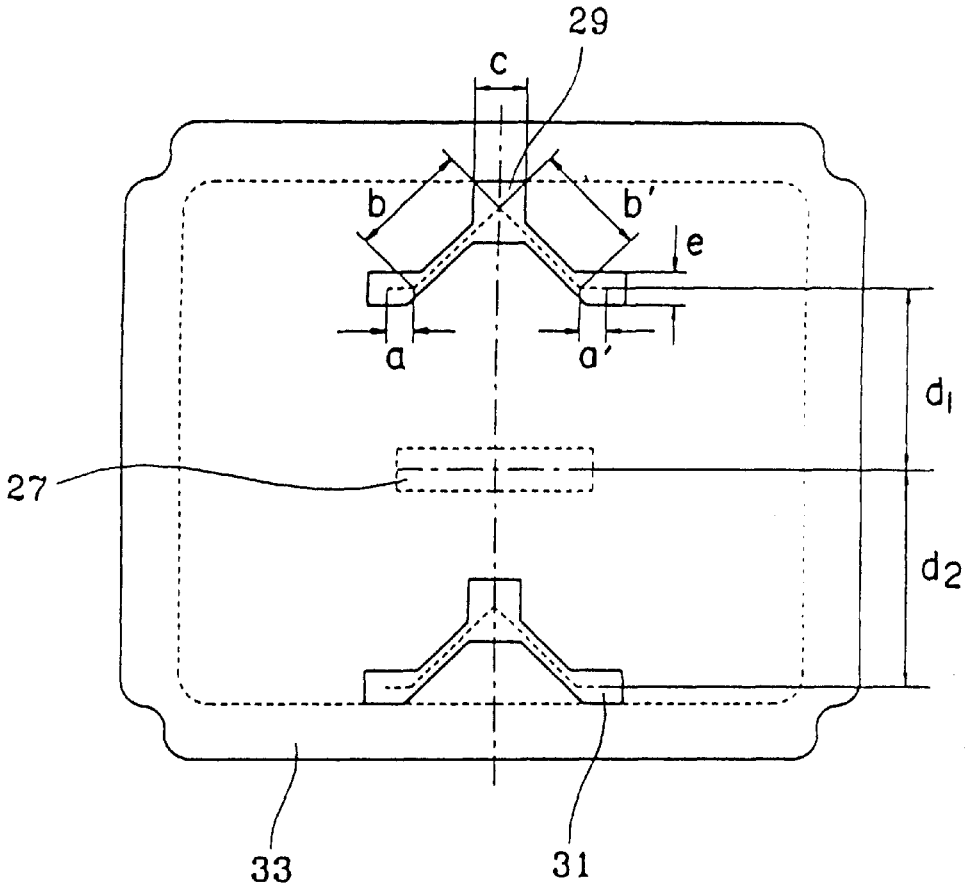
FIG. 7 is a perspective view of a radiating hole in accordance with the present invention.

The radiating hole(29) of the first output waveguide(23) and that(31) of the second output waveguide(25) in FIG. 7 are respectively formed at top and bottom portions of the cavity(33) centering the power supply hole(27) to spray microwaves with electric fields of opposite phases into the cavity(16).

At this time, the radiating hole(29) of the first output waveguide(23) and that(31) of the second output waveguide (25) are respectively placed with their centers positioned at a predetermined distance, a distance of $\lambda_g/4$, from the power supply hole(27) of the input waveguide(21). Therefore, a distance between the two radiating holes of the first and second waveguides(23 and 25) is $\lambda_g/2$. The two radiating holes of the first and second waveguides(23 and 25) are symmetrically formed in a same shape.

At this time, the horizontal lengths between the radiating hole(29) of the first output waveguide(23) and that(31) of the second output waveguide(25) are respectively expressed as $a+b=\lambda_g/4$ and $a'+b'=\lambda_g/4$. Therefore, the total horizontal length between the two radiating holes is $\lambda_g/2$. In addition, the upper width(c ) of each radiating hole of the two output waveguides is formed at $\lambda_g/8$ while their lateral width(e) is formed at $\lambda_g/16$, c/2.

Next, the operational effect of the present invention is described in detail below. The microwaves generated from the magnetron(18) are transmitted through the first output waveguide(23) and the second output waveguide(25). In other words, the microwaves generated from the magnetron (18) are transmitted partly to the first output waveguide(23) and partly to the second output waveguide(25).

The first output waveguide(23) radiates microwaves supplied through the input waveguide(21) through the radiating hole(29) while the second output waveguide(25) radiates microwaves through the radiating hole(31). The microwaves radiated through the two radiating holes(29 and 31) are radiated into the cavity.

At this time, the output of microwave oven is expressed as total energy of the microwaves radiated through the two radiating holes(29 and 31) of the respective output waveguides(23 and 25). The electric field energy of the microwaves radiated through the respective radiating holes (29 and 31) contains at symmetric size and phase, so that the microwave energy is related to the total energy of the microwaves radiated through the respective radiating holes (29 and 31).

Figure 8:
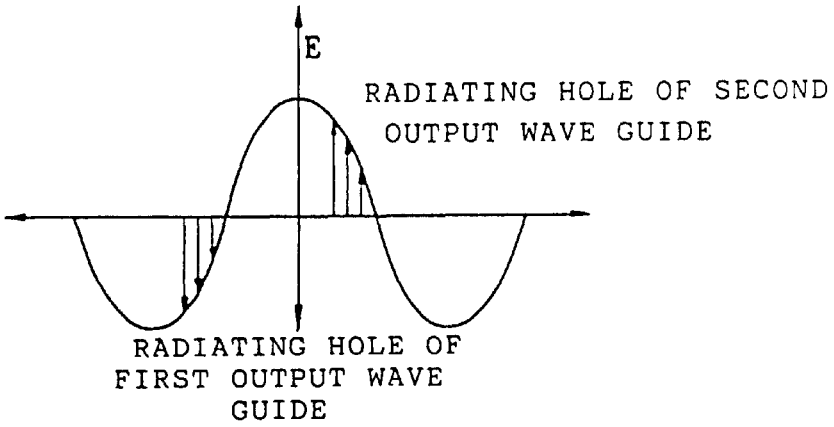
FIG. 8 is a structure analysis drawing of a waveguide in accordance with the present invention.

As shown in FIG. 8, the microwaves radiated through the radiating hole(29) of the first output waveguide(23) have an electric field which gradually gets larger at $\lambda_g/4$ later than the microwaves supplied through the power supply hole(27) of the input waveguide(21). On the other hand, the microwaves radiated through the radiating hole(31) of the second output waveguide(25) have an electric field which gradually gets smaller at $\lambda_g/4$ earlier than the microwaves supplied through the power supply hole(27) of the input waveguide (21). Therefore, the two electric fields at opposite phases are radiated into the cavity.

Figure 9:
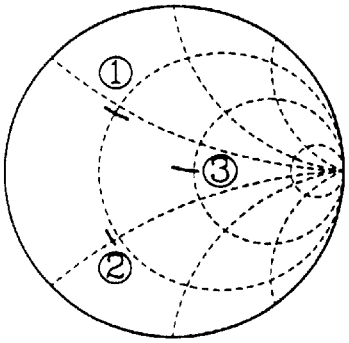
FIG. 9 is a polar chart of impedance of a microwave oven in accordance with the present invention.

As shown in FIG. 9, impedance of the waveguides in accordance with the present invention is compounded impedance of the two radiating holes(29 and 31) of the first and second output waveguides(23 and 25). If the radiating hole(29) of the first output waveguide(23) is blocked, the impedance is positioned at 1. If the radiating hole(31) of the second output waveguide(25) is blocked, the impedance is positioned at 2. The compounded impedance of the two radiating holes(29 and 31) are positioned at 3.

Figure 10:
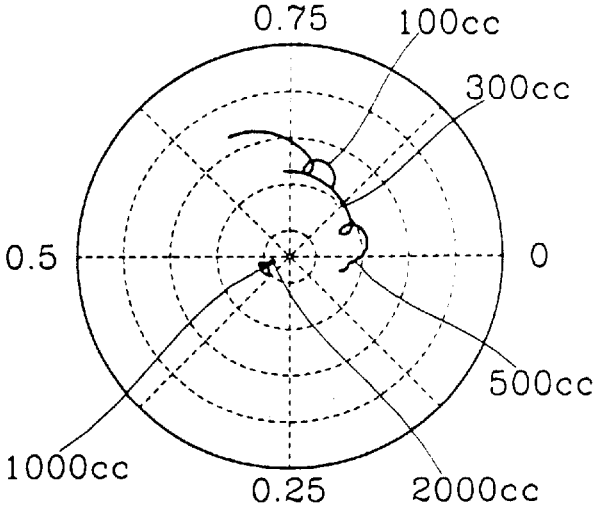
FIG. 10 PRIOR ART
FIG. 10 is a polar chart of impedance of a microwave oven depending on food load in accordance with the prior art.
Figure 11:
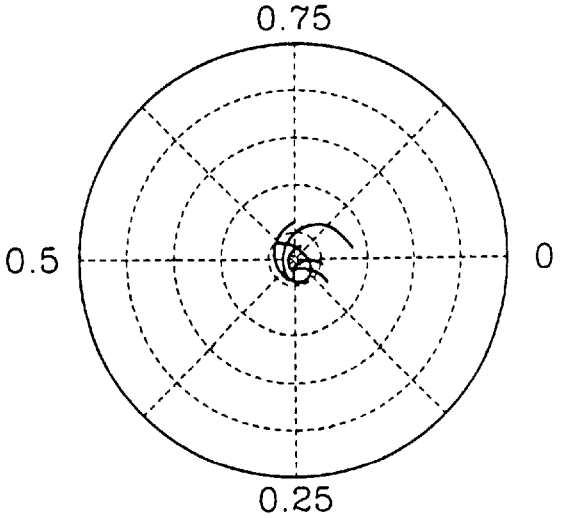
FIG. 11 is a polar chart of impedance of a microwave oven depending on food load in accordance with the present invention.

As the impedance of the waveguides is compared depending on food load in FIG. 10, the impedance change between a high food load(1000–2000 cc) and at low food load (100–500 cc) is large in a conventional microwave oven, while the impedance in a microwave oven of the present invention is kept constant regardless of food load.

Figure 12:
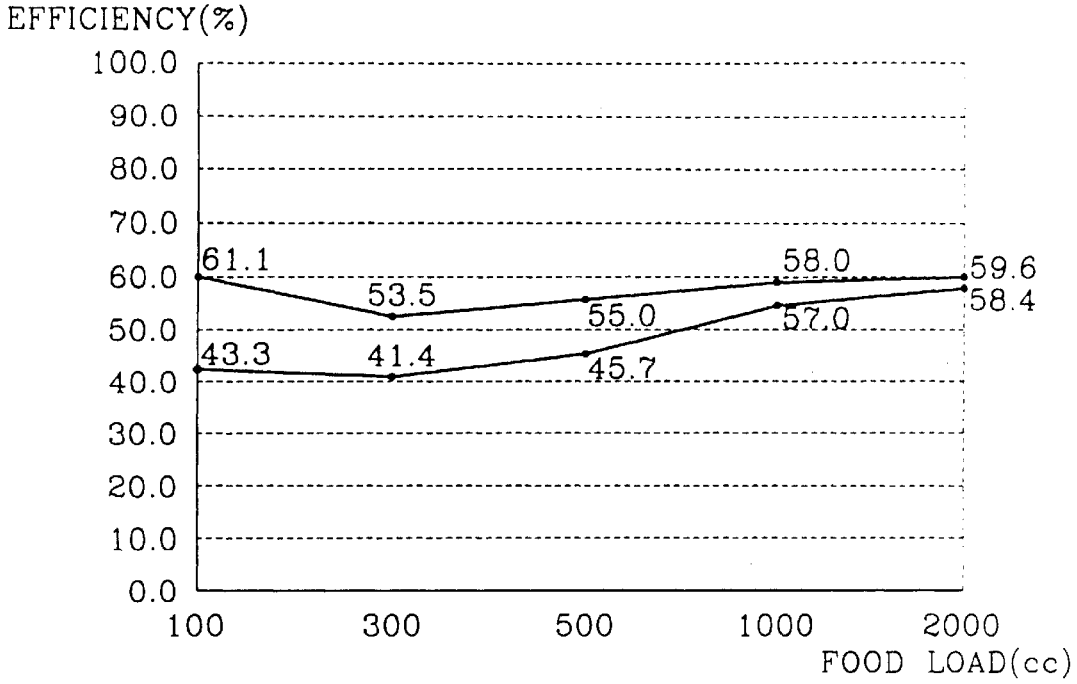
FIG. 12 is a graph for comparing the efficiency of microwave ovens in accordance with the prior art and the present invention.

As a graph comparing the operational efficiency of the microwave ovens between in the prior art and in the present invention is shown in FIG. 12, the present invention is more advantageous because the quantity of reflected microwaves is lower, thereby resulting in a high efficiency at low food load and because the operational difference is little depending on food load.

In addition, there is a further advantage of the present invention in that microwaves are properly radiated through the respective radiating holes(29 and 31) of the first and second output waveguides(23 and 25), thereby achieving an equalized heating.

Figure 13A:
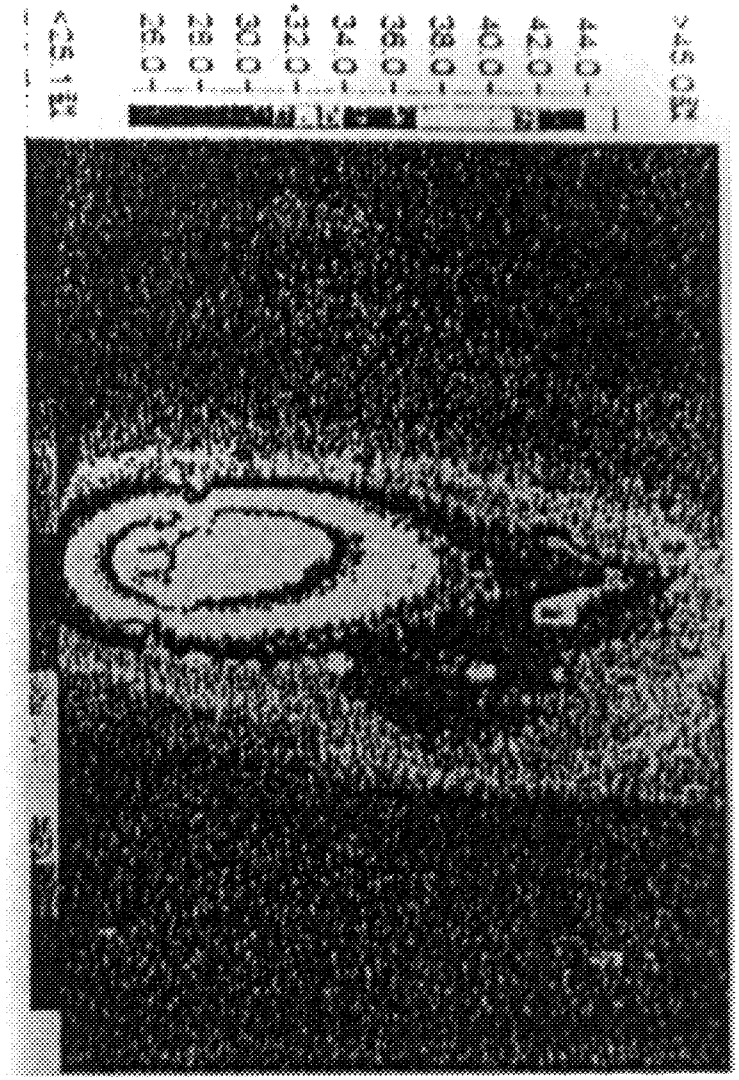
FIGS. 13*a–d* are pictures for showing the radiating state of microwaves depending on food load in accordance with the present invention.
Figure 13B:
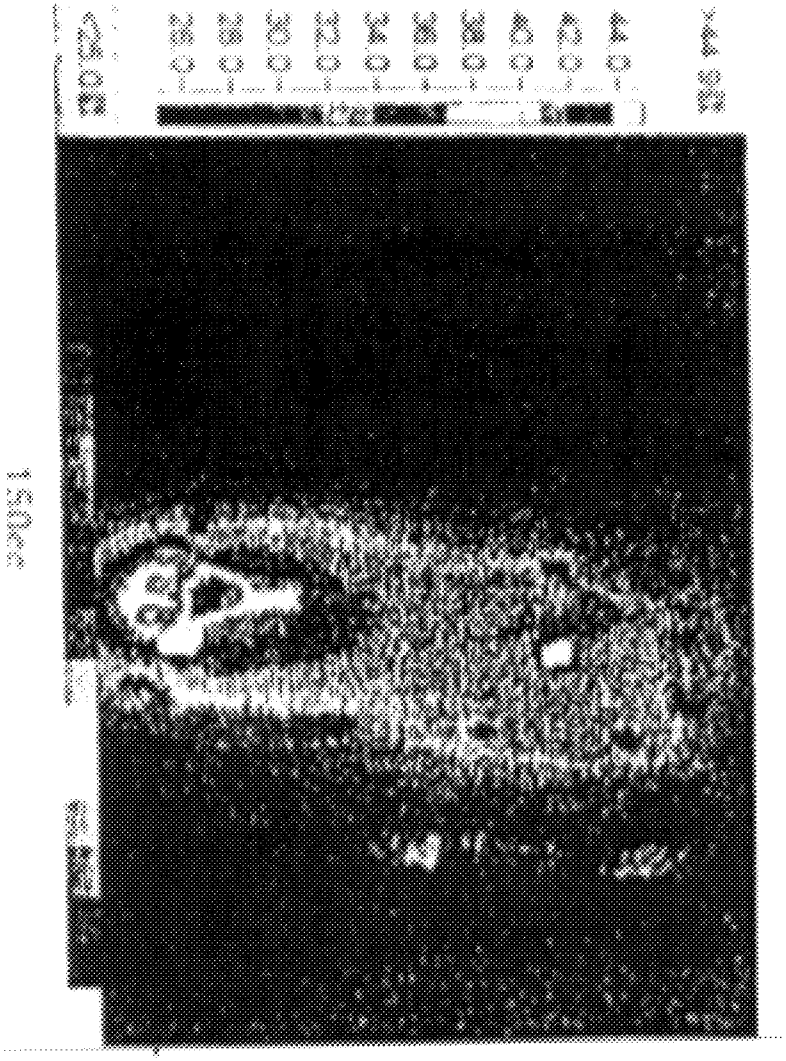

FIGS. 13*a* and 13*b* are pictures for showing the radiating state of microwaves depending on food load in accordance with the present invention. The temperature of the microwave oven is measured by using the ultraviolet camera. A ferrite plate is placed for high absorption of the microwaves at the wall having the radiating holes to measure temperature at various positions of the microwave oven after the magnetron is driven.

Figure 13C:
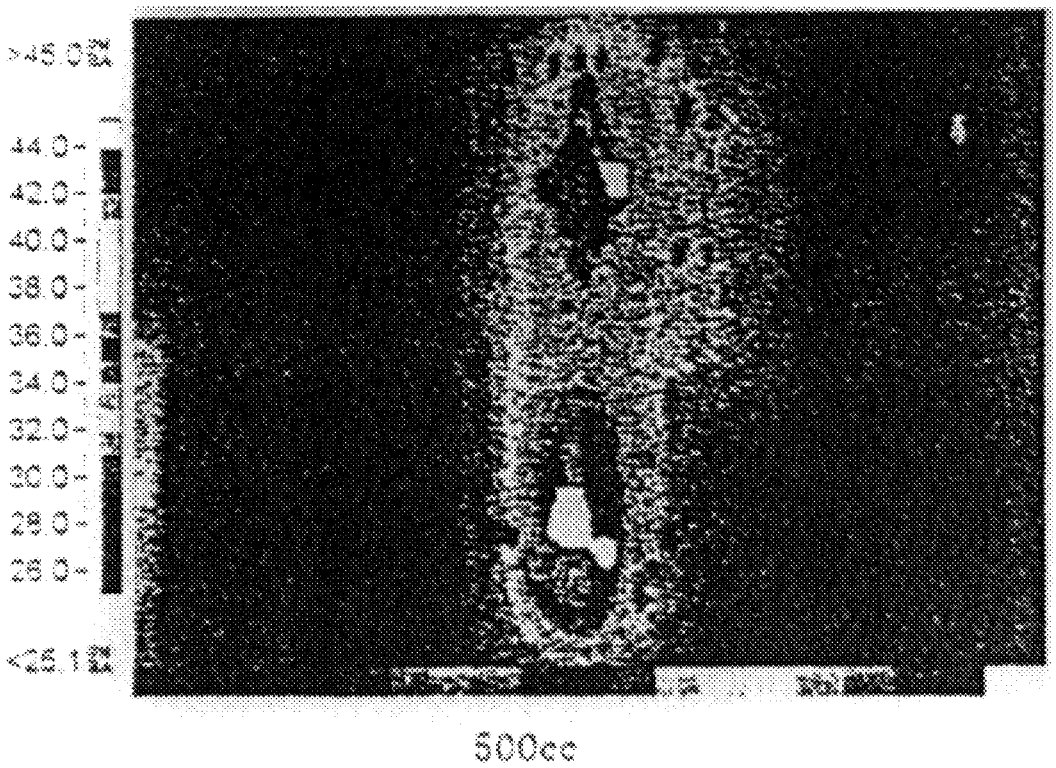
Figure 13D:
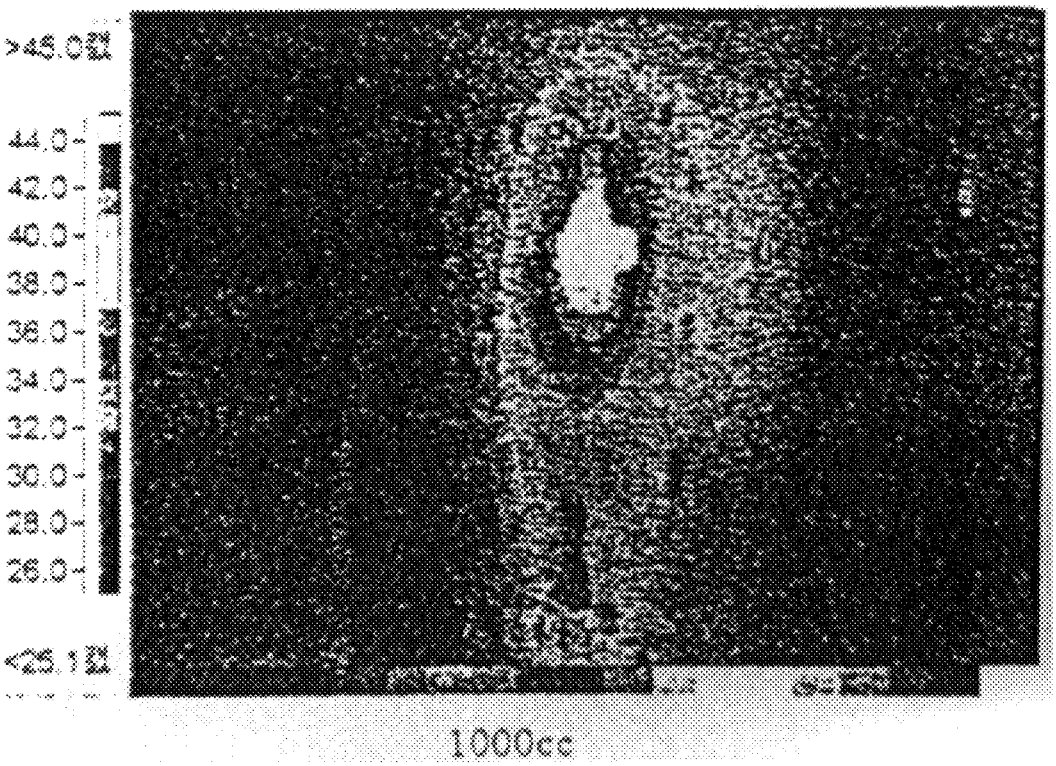

As shown in FIGS. 13*a* and 13*b*, microwaves are mainly radiated through the radiating hole(31) of the second output waveguide(25) disposed at the bottom of the cavity in case food load for cooking is none and low (150 cc). As shown in FIG. 13*c*, microwaves are properly divided and radiated through both of the radiating holes(29 and 31) of the first and second output waveguides(23 and 25) in case food load is medium (500 cc). As shown in FIG. 13*d*, microwaves are mainly radiated through the radiating holes(29) of the first output waveguide(23) in case food load is high (1000 cc).

Figure 14:
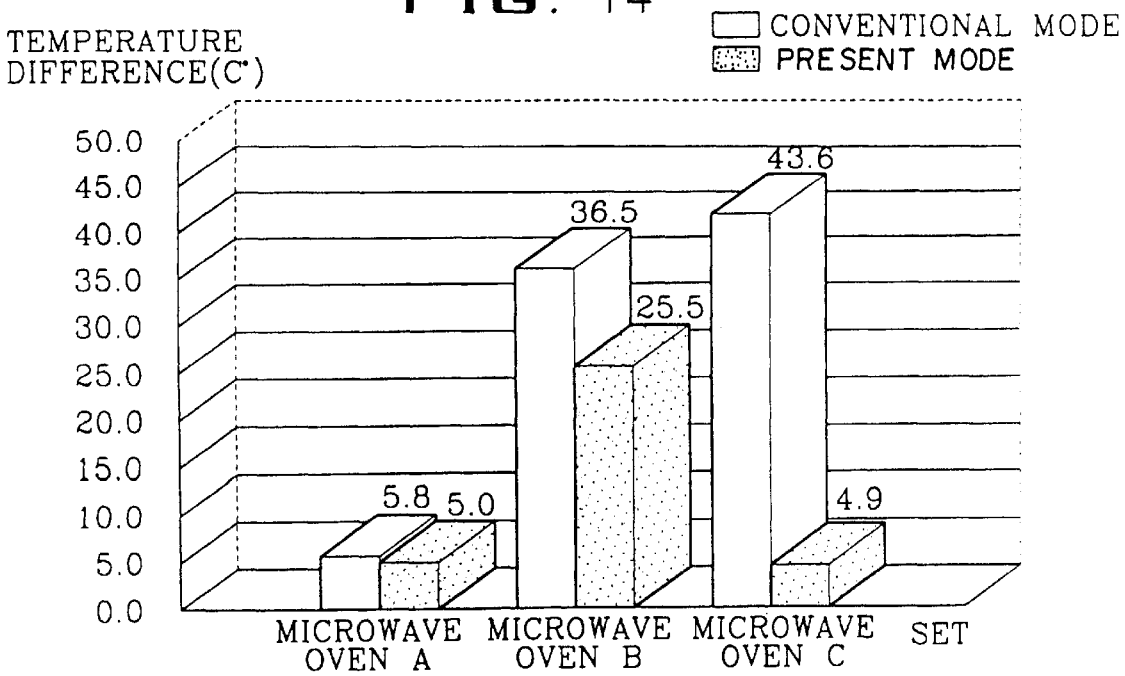
FIG. 14 is a graph for comparing temperature difference of milk at microwave ovens in accordance with the prior art and the present invention.

FIG. 14 shows the maximum temperature difference of milk contained at a bottle as the temperature is measured at the upper and lower parts thereof after the milk is heated at respective microwave oven in accordance with the prior art and the present invention. It is found that the microwave oven of the present invention provides a smaller temperature difference between the two parts of the milk contained at a bottle.

As a microwave oven of the present invention radiates into the cavity the microwaves generated from the magnetron at opposite phases, change in impedance of the waveguide depending on food load to be cooked is minimized, thereby getting the output of the microwave oven and the electric field distribution at the cavity kept regardless of food load.

What is claimed is:

1. A microwave oven comprising:

a source of microwaves;

a cooking chamber; and a waveguide means configured to guide microwave energy from said source of microwaves to said cooking chamber, said waveguide means including two output apertures which couple said waveguide means to said cooking chamber, said output apertures being arranged such that electric fields of the microwaves radiated through said apertures from said waveguide means into said chamber are in anti-phase, a first waveguide having said two output apertures spaced apart in a first wall thereof, and having an input aperture in a second wall thereof opposite to the first wall and in a position mid-way between said two output apertures, and a second waveguide which conveys microwave energy from said source of microwave energy to said input aperture.

2. A microwave oven as claimed in claim 1, wherein said output apertures are symmetrically formed in a same shape with a distance of $\lambda_g/2$ therebetween.

3. A microwave oven as claimed in claim 1, wherein said output apertures are respectively placed with their centers positioned at a distance of $\lambda_g/4$ from said input aperture.

4. A microwave oven as claimed in claim 1, wherein said output apertures are formed in a horizontal symmetry.

* * * * *